US006101863A

United States Patent [19]

Liinamaa et al.

[11] Patent Number: 6,101,863

[45] Date of Patent: Aug. 15, 2000

[54] SHEET FABRICATION MACHINE, AND METHOD THEREFOR, FOR OPTIMALLY FABRICATING WORKSHEETS

[75] Inventors: Kari Liinamaa, Ylihärmä ; Mika Virtanen, Seinäjoki, both of Finland

[73] Assignee: Lillbacka Jetair Oy, Kauhava, Finland

[21] Appl. No.: 09/302,493

[22] Filed: Apr. 30, 1999

Related U.S. Application Data

[63] Continuation of application No. 09/056,776, Apr. 8, 1998, Pat. No. 6,021,658.

[30] Foreign Application Priority Data

Apr. 25, 1997 [FI] Finland ..... 971762

[51] Int. Cl.[7] ..... B21J 9/18

[52] U.S. Cl. ..... 72/452.8; 72/452.1; 72/452.9

[58] Field of Search ..... 72/452.1, 452.2, 72/452.8, 442, 452.9

[56] References Cited

U.S. PATENT DOCUMENTS

| | | | |
|---|---|---|---|
| 1,999,057 | 4/1935 | Peterson et al. . | |
| 4,296,614 | 10/1981 | Valks . | |
| 5,186,037 | 2/1993 | Bihler | 72/442 |
| 5,199,293 | 4/1993 | Catti et al. . | |

FOREIGN PATENT DOCUMENTS

| | | | |
|---|---|---|---|
| 1218389 | 6/1966 | Germany . | |
| 26 40 318 | 3/1978 | Germany . | |
| 435037 | 7/1974 | U.S.S.R. | 72/452.1 |
| 584961 | 11/1977 | U.S.S.R. | 72/452.8 |

*Primary Examiner*—David Jones
*Attorney, Agent, or Firm*—Louis Woo

[57] ABSTRACT

The working machine comprises a first (ET) and a second (TT) machining means, at least the first one (ET) being arranged to move in relation to the machine body (28) towards the second one (TT), to accomplish machining of a sheet material, wherein the sheet material to be worked is placed between the machining means (ET) and (TT). At least one of the machining means (ET and TT) is provided with means (7, 9) for conducting the transfer and working movements of said tool (ET, TT). The first part (7) of the means is fixed to the machining means (ET, TT), and the second part (9) of the means is fixed to the machine body (28), to be movable in relation thereto by actuators (10, 11, 14–26, 39, 41) in the machine body (28). The movement of the second part (9) of the means (7, 9) in relation to the machine body (28) during machining based on pressing of the sheet material is transmitted from the second part (9) to the first part (7) by a contact surface connection. The first part (7) and/or the second part (9) of the means (7, 9) is equipped with at least one guide surface part (36) which is formed as a bevelled surface in relation to the direction of movement of the machining means (ET, TT). The position of the contact surface connection between the first part (7) and the second part (9) of the means in relation to the guide surface part (36) will define the position of the machining means (ET, TT). According to the invention, the guide surface part (36) is provided with at least a first portion **(36*a*) for conducting the transfer movements of the machining means (ET, TT) and a second portion (36*b*)** for conducting the working movements based on pressing of the sheet material to be worked with the machining means (ET, TT).

16 Claims, 7 Drawing Sheets

F
10
11
37
1
40
35
30
39
8
9
7
42
14
41
29
32
31
34
44

F
10
11
37
1
40
35
30
39
8
9
7
42
14
41
29
32
31
34

SHEET FABRICATION MACHINE, AND METHOD THEREFOR, FOR OPTIMALLY FABRICATING WORKSHEETS

This is a continuation of Ser. No. 09/056,776, filed Apr. 8, 1998, now U.S. Pat. No. 6,021,658.

The invention relates to a sheet fabrication machine and more specifically to the movement of the mechanism that drives the punch tool.

BACKGROUND OF INVENTION

U.S. Pat. No. 5,092,151 and U.S. Pat. No. 5,199,293, a continuation of the '151 patent, each disclose particularly sheet working centers intended for bending, whereby separate means are used for accomplishing the approaching movement of the tool on one hand, and the actual working movement on the other hand. The means for accomplishing the approaching movement of the tool are constructed in a way that the approaching movement is relatively quick, and on the other hand, the means for accomplishing the actual working movement are constructed in a way that their movement is relatively slow in relation to the movement of the first means. On the other hand, the second means are constructed so that the force effect to be accomplished with them is considerably greater for the working of the sheet than the force effect accomplished by the movement of the first means which accomplish only a linear movement.

In said U.S. publications, the second means comprise a first gliding means fixed to a buffer arranged to be movable in the vertical direction, and a second gliding means arranged to move by actuators in the horizontal direction, wherein the working movement of the second means is accomplished by a wedging effect between the first and second gliding means. Between the wedge surfaces in the first and second gliding means, there are roll surfaces, by means of which the movement of the horizontally moving, wedge-like second gliding means is transmitted to the second gliding means as a vertical movement and thus to the working movement of the tool in the buffer bar.

The solution as set forth in the publications U.S. Pat No. 5,092,151 and U.S. Pat. No. 5,199,293 is disadvantageous in the respect that the approaching movement and the working movement are arranged to be effected by separate means and actuators using them. In consequence, firstly the construction using such a method is complex and expensive, because of the high investments on the required equipment; secondly, a complex control system is required for the successive approaching and working movements, which may easily cause operational risks.

SUMMARY OF INVENTION

It is an aim of the present invention to eliminate the above-mentioned disadvantages of prior art and thus to improve the level of technology in the field.

In particular, the instant invention sheet fabricating machine provides a tool means that has a configured top portion that coacts with a driving mechanism such that as the drive mechanism is moved along a given direction, the tool means is driven in a direction substantially perpendicular to the movement axis of the drive mechanism. Such drive mechanism includes a servo motor driving a screw. Mounted to the drive screw is a transfer carriage at the end of which is attached a rolling, or slide, mechanism. It is the rolling mechanism that, when driven by the transfer carriage whose movement is effected by the rotation of the servo motor, controls the movement of the tool means in a direction perpendicular to the plane of the worksheet. Thus, when a worksheet is placed between a punch tool that forms a part of a tool means and a die, it can readily be machined by the punch, as the tool means is driven by the rolling mechanism. To enable the rolling mechanism to drive the tool means, the top of the tool means is configured as a beveled cam having two sloping sides that meet to form an inverted apex or lowermost point. Thus, when the rolling mechanism comes into contact with the inverted lowermost point of the tool means, the punch is moved to its furthest position to thereby effect the machining, for example the punching, of a hole in the worksheet. Given that the top of the tool means is configured to include two opposed slopes, other types of machining of the worksheet can be effected insofar as the movement of the rolling mechanism can be precisely controlled by the actuation of the servo motor. Thus, the worksheet can be machined by the punch of the tool means at different depths, by controlling the contact surface connection or interaction between the rolling mechanism and the configured top of the tool means.

BRIER DESCRIPTION OF THE DRAWINGS

In the following, the invention will be described with reference to the appended drawings. In the drawings, FIGS. 1*a–c* to 3*a–c* illustrate in a schematical and reduced manner, seen from the side, three advantageous implementation alternatives 1*a* to 3*a* of the invention, power/time diagrams 1*b* to 3*b*, and the respective guide surface parts 1*c* to 3*c*, FIG. 4 shows a detailed apparatus application of the FIG. 1 invention, seen from the side of the apparatus, FIG. 5 shows the apparatus of FIG. 4 seen from the end, FIG. 6 shows different steps a to d of the method implemented with the embodiment according to FIGS. 1, 4 and 5 in cutting work, and FIG. 7 shows different steps a to c of the method implemented with the embodiment according to FIGS. 1, 4 and 5 in molding work.

DETAILED DESCRIPTION OF THE INVENTION

Figure 1A:
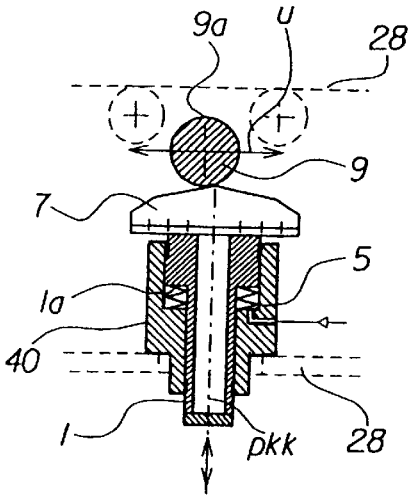

With reference to FIGS. 1 to 3, a machine body 28 is provided with a buffer bar or ram 1 to move in the vertical direction in a cylindrical clamp 40 in the machine body. A pneumatic chamber 5, possibly equipped with a spring, is effective between the front surface la of a flange in connection with the buffer bar 1 and the machine body 28, for accomplishing the return movements of the buffer bar. Fluid may be input to chamber 5 from valve 4. The top part of the buffer bar 1 is equipped with means 7, 9 for accomplishing the movements of the buffer bar 1 and the tool in a power transmission connection with the same in a direction that is substantially perpendicular to the level of the die (FIG. 4). The first part 7 of the means, which may be referred to as the cam of ram, is fixed to the top part of the buffer 1 and the second part 9 of the means, which may be rotatable mechanism such as a roller that acts as a contact means with first part 7, is fixed to the machine body 28 to be movable in relation to the same by using actuators in the machine body 28.

According to the method, the movement of the second part 9 of the means 7, 9 in relation to the machine body 28 is transmitted from the second part 9 through a contact means or contact surface connection, which may be a cam with a particular configuration, to the movement of the buffer bar 1 in connection with the first part 7 and the tool 29 attached to the same—both as the approaching and the working movement. Either the first part 7 or the second part 9 or both are equipped with a contact surface part 36 which is formed as a substantially bevelled surface in relation to the longitudinal direction of the buffer bar 1. In particular, in place of what is shown in FIG. 4, cam 7 as shown in FIG. 1*c* may be attached to the end of horizontal transfer bar 19 so that it is cam 7 that is driven by servomotor 25 via the screw drive 21. Further, instead of having cam 7 placed on top of buffer bar 1, the auxiliary body 41 could be formed at the top of buffer bar 1 so that as cam 7 is driven by servomotor 25, buffer bar 1 is caused to move in the vertical direction by the contact that is made between the surfaces of cam 7 and the rollers of auxiliary body 41. In this instance, cam 7 could be considered as a drive member that has a fixed configuration surface, which corresponds to the guide surfaces 36*a–c* as shown in FIG. 1*c*. Given that the drive member is inverted, its lowermost point would be similar to that of 37 as shown in FIG. 1*c*. Furthermore, the fixed configuration surface of the inverted cam 7 can have the configuration as shown in FIG. 2*c*, so long as the top of buffer bar 1 is fitted with a circular roller, or a low friction slider, such as that designated as 9 shown in FIG. 2*a*. The same reversed configuration for the drive member and the top of the buffer bar 1 is equally applicable with regard to the configured contact surfaces and top of the buffer bar 1 as shown in FIG. 3. Cam 7 can be configured such that it has as its lowermost point a reversed apex, that coacts against the contact mechanism configured on top of the buffer bar 1 for driving the punch along the vertical direction.

It is common to all the embodiments of FIGS. 1 to 3 that the guide surface part 36 is provided with at least a first portion 36*a* for accomplishing the transfer movements of the buffer bar and the tool fixed therewith, and a second portion 36*b* for accomplishing the working movements of the buffer bar 1 and the tool 29 in a power transmission connection therewith on a sheet or workpiece 32.

In the embodiment of FIG. 1, the first part 7 is arranged as a shaper plate or cam comprising the guide surface part 36 and placed in the machine body 28 parallel to the linear movement (arrow LL) of the roll-like second means so that the first portion 36*a*, second portion 36*b* and also third portion 36*c* of the guide surface part, where the buffer bar 1 is in the tool exchange position, are successive in the direction of the linear movement LL. The second part 9 is formed as at least one rolling means, preferably a roller whose peripheral surface 9*a* is in a contact surface connection with the guide surface part 36 of the first part 7. The linear movement LL of the second part 9 during application of the method is advantageously directed perpendicular to the longitudinal and movement direction of the buffer bar 1.

In the embodiment of FIG. 1, the guide surface part of the first part 7 is formed symmetrical and equiform in relation to the end point between the halves of the guide surface part 36, i.e. in this case the inversion or apex point 37. The inversion point 37 is placed on the central line PKK in the longitudinal direction of the buffer bar 1, wherein said inversion point determines the terminal point of the working movement of the tool when applying the method.

In the embodiments of FIGS. 2 and 3, in difference to the embodiment of FIG. 1, the movement of the second part 9 is arranged as a rotational movement around an axis A.

Figure 2A:
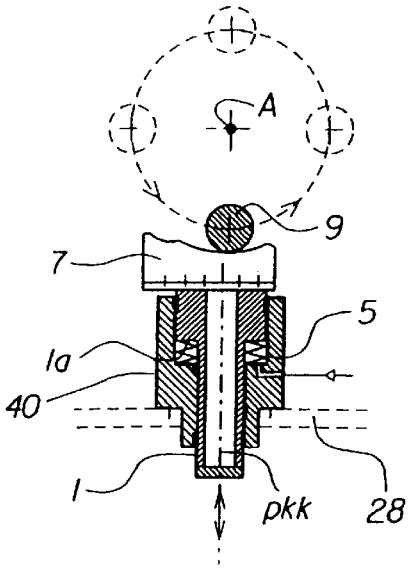
Figure 2B:
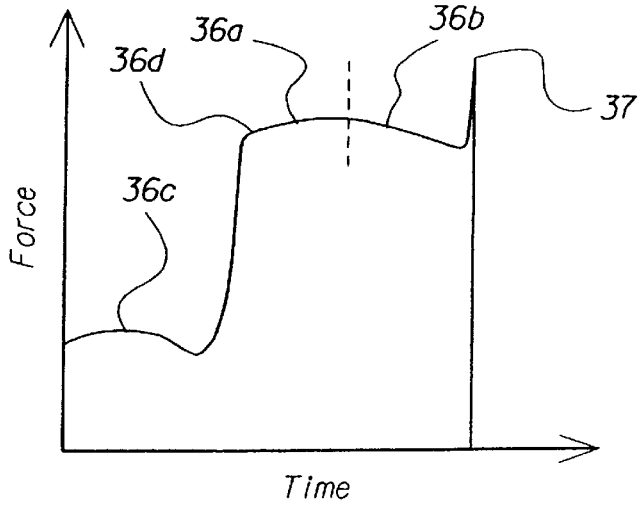
Figure 2C:
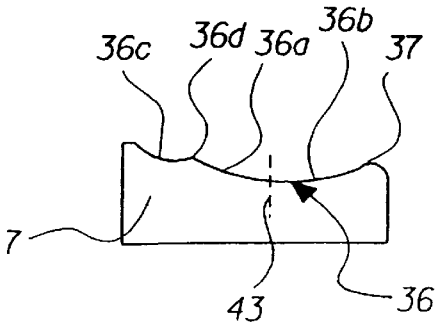

In the embodiment of FIG. 2*a–c*, the longitudinal direction of the central line of the rotational movement of the second part 9 is placed in an inclined or preferably perpendicular position in relation to the longitudinal direction of the central line PKK of the buffer bar 1. Thus, the guide surface part 36 in connection with the shaper or cam plate forming the first part 7 in connection with the buffer bar 1 is shaped as a curved, particularly circular surface. Further, in the direction of the circumference of the rotational movement of the second part 9, there may be two or more rolling means, preferably rollers, arranged in succession to accomplish a contact surface connection with the guide surface part 36 of the first part 7. The rollers are mounted on bearings in a body frame rotating around the axis A so that their rotation axis is parallel to the axis A. The curved guide surface part 36 (FIG. 2*c*) is formed as a longitudinal curved surface whose longitudinal direction is aligned with the plane of the rotational movement of the second part 9 so that the first portion 36*a* of the curved shape extends at the beginning of the curved form and the second portion 36*b* extends from the bottom of the curved form to the terminal point 37 of the curved form where the rolling means 9 is disengaged from the guide surface part 36. The third portion 36*c* of the guide surface part 36 extends as a separate curved form in extension to the portions 36*a* and 36*b*, wherein the second part 9 is placed in the upper position of the buffer part 1 in a contact surface connection with the third portion 36*c* during a tool exchange. When starting the transfer movement of the buffer bar 1 after a tool exchange, the second part 9 moves from the third portion 36*c* to the first portion 36*a* of the guide surface part 36 over a beak 36*d* placed between the third portion 36*c* and the first part 36*a* of the left guide surface part in the embodiment of FIG. 2*a–c*. FIG. 2*c* shows further the division of the guide surface part 36 into the portions 36*a* and 36*b* by a broken line 43.

Figure 3A:
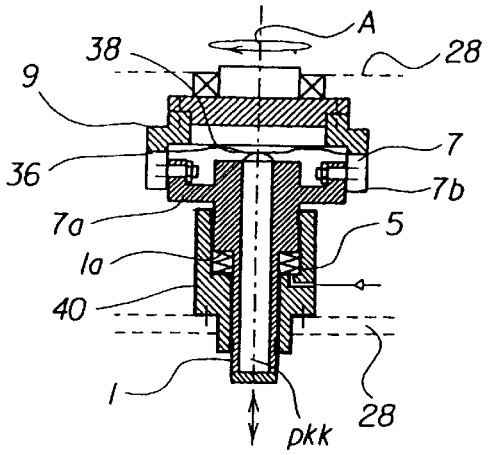
Figure 3B:
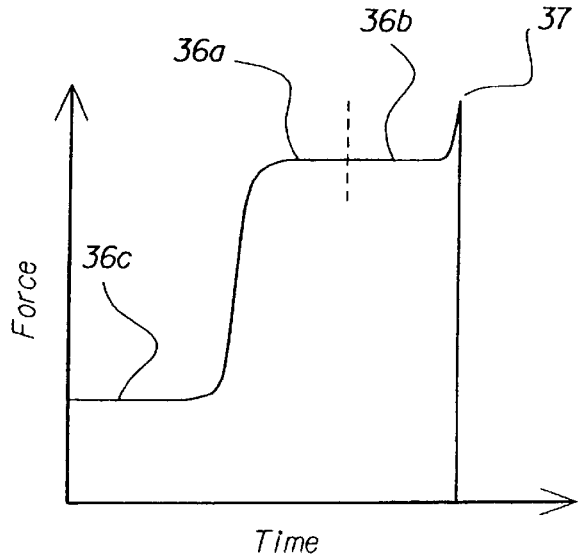
Figure 3C:
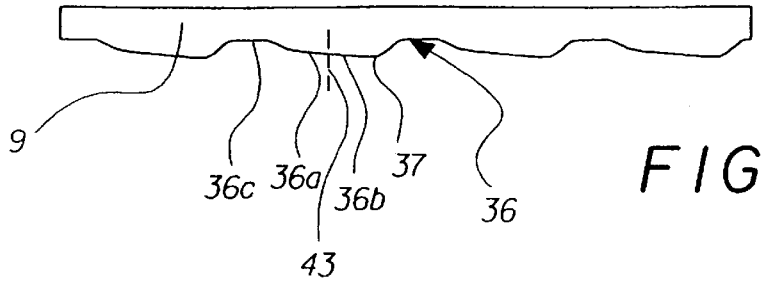
Figure 4:
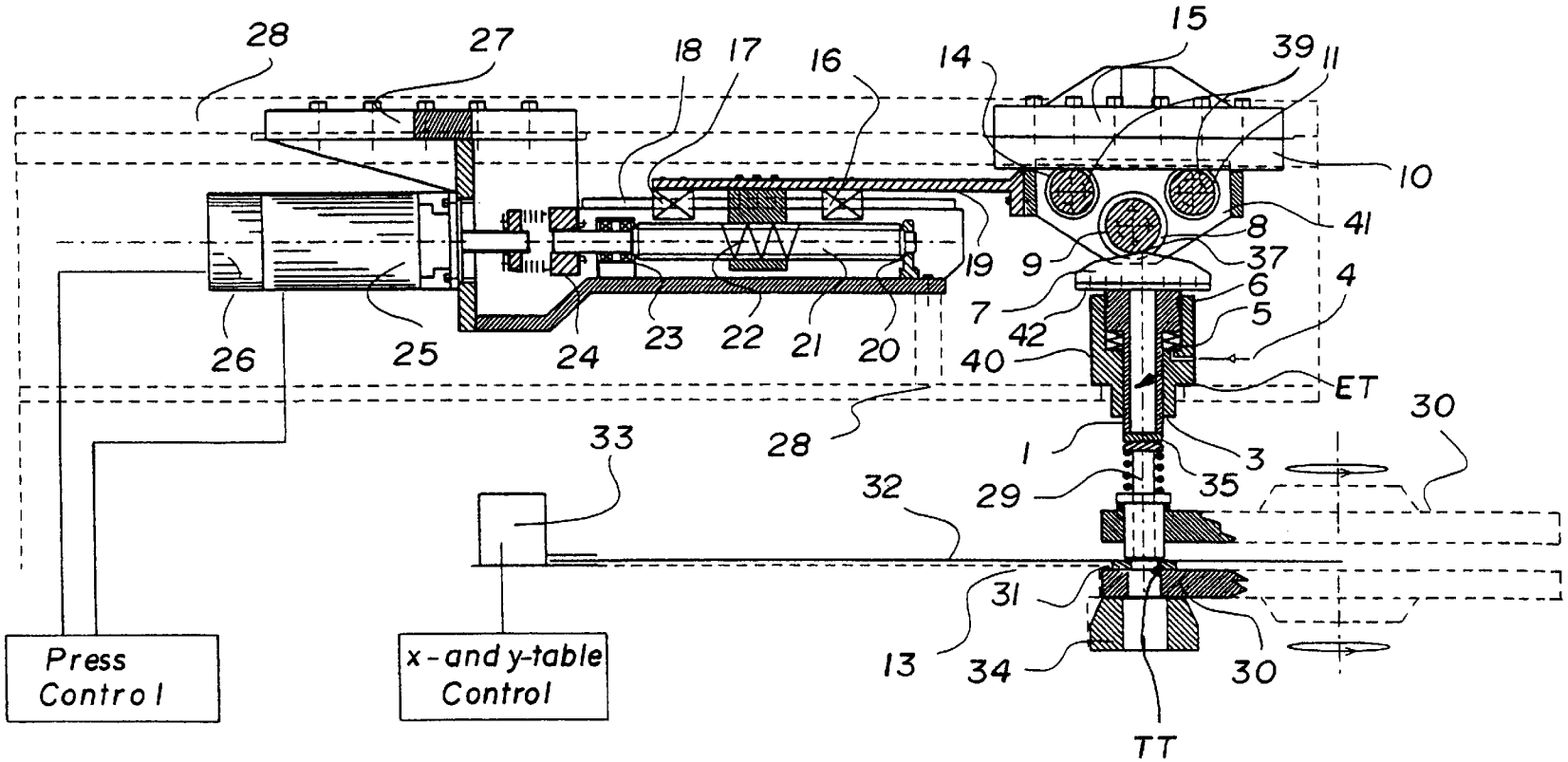

FIG. 3*a–c* shows an embodiment of the method according to the invention where, contrary to the embodiments above, the central line A of the rotational movement of the second part 9 is placed in alignment and to unite with the longitudinal central line PKK of the buffer bar 1. Thus, it is possible to place the rolling means, e.g. rollers, forming the first part 7 of the means 7, 9, in connection with the buffer bar 1, mounted on bearings by means of guide bolts 7*b* on the circular frame body 7*a* fixed to the buffer bar 1, wherein the rolling means forming the first part 7 rotate, supported by the frame body 7*a*, in the horizontal plane around radial axes 7*a*. In a corresponding manner, the guide surface part 36 (FIG. 3*c*) is formed in connection with the second part 9, wherein it comprises in the shape of a circle or ring with two or more zones 38 which are each substantially equal in shape and in which the portions 36*a–6c* are placed so that each rolling means forming the first part 7 and rotating when supported by the frame body 7*a* are at the same stage of contact surface connection. FIG. 3*c* shows, displayed in a plane, the guide surface 36, wherein a broken line 43 indicates the point of change between the portions 36*a* and 36*b* in the inclined portion of the guide surface 36. The portion 36*c* consists of an indentation in the guide surface 36.

FIGS. 1*b* to 3*b* show further the time/force curves formed in connection with the corresponding embodiments, and the corresponding portions of the guide surface part 36 particularly in the cutting machining embodiment.

With reference to FIGS. 4 to 7, the apparatus assembly used in the method of the invention and applied in the sheet machining center or sheet fabrication machine such as for example a turret punch machine operates in the following way. The sheet 32 to be worked that is fixed by normal clamping jaws to be transferred in the X,Y direction on a horizontal working table, plane or surface 13, is placed in the desired position on the working surface 13 for machining operations by means of an X,Y transfer device 33 such as for example a servo motor, in connection with the clamping jaws. The working surface 13 is equipped with a die 31 which is substantially on the same plane or slightly upwards protruding above a lower stop 34 and on top of which the area of the sheet to be worked, i.e. cut and/or molded, is placed. Above the die 31, on the opposite side of the sheet 32, there is a tool 29 which is, in the same way as the die 31, fixed to a rotating tool revolver or turret 30 (shown by broken lines). The tools 29 and corresponding dies in the tool revolver 30 can be exchanged by turning the tool revolver 30 to the end 35 of the buffer bar 1 and the lower stop 34. The buffer bar or ram 1 is an elongated form piece with a circular cross-section, fixed to the cylindrical clamp 40 of the buffer bar 1 in connection with the machine body 28, to be movable in the direction of its longitudinal axis. A sliding bearing system 3, 6 is effective between the cylindrical clamp 40 of the buffer bar 1 and the outer surface of the buffer bar.

In the expanded top part of the buffer bar 1, above the buffer bar 1 is fixed the first part 7 of the means 7, 9 which is, in the embodiment (see also FIG. 1) a vertically positioned elongated plate-like form or cam piece whose upper edge is formed as the guide surface part 36. The first part 7 is thus placed in the top part of the buffer bar 1 so that the guide surface part 36 of its upper edge is parallel with the direction of the linear movement of the second part 9 of the means 7, 9. For the instant invention, not to be limiting, cam 7 in combination with buffer bar 1 and its cylindrical clamp 40, as well as tool 29, may all be referred to simply as the tool means or punch means.

Figure 5:
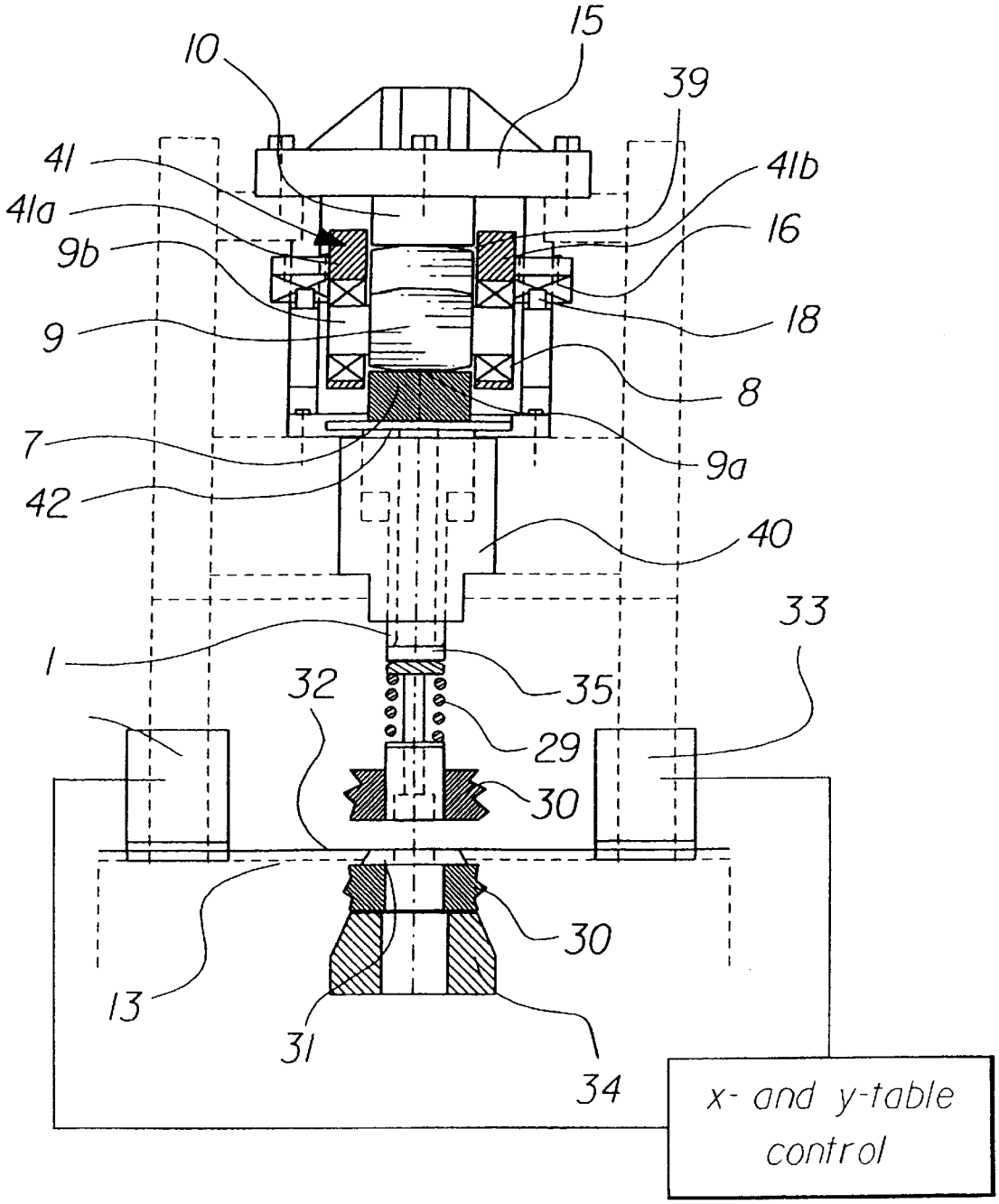

The outer surface 9*a* of the second part 9 is in a contact surface connection with the guide surface part 36 of the first part 7. The second part 9 is mounted on bearings in an auxiliary body 41 mounted in the machine body 28. The roll-like second part 9 comprises an axle part 9*b* (see FIG. 5) which is mounted on bearings in the plate-like elements 41*a*, 41*b* of the auxiliary body on both sides of the second part 9. The auxiliary body 41 is also equipped with rolling means 39 separate from the second part 9. In the presented embodiment, there are two rolling means 39 placed horizontally on opposite sides of the second part 9, seen from the side direction of FIG. 4, at such a height position in connection with the auxiliary body 41 that the outer peripheries of the rolling means 39 are in a contact surface connection with a stop beam 10 belonging to a guiding device in connection with the auxiliary body 41, the top thereof. The stop beam 10 is linear, wherein the auxiliary body 41 conducts a linear movement that is transmitted to a linear movement of the second part 9, the second part 9 rolling in a contact surface connection with the guide surface part 36 during the movements of the buffer bar 1. In FIG. 5, the reference numeral 8 indicates the rolling bearings of the second part 9 by which said elements are mounted on bearings with the auxiliary body 41. Further, the auxiliary body unit 41 comprises a stop body 15 belonging to a guiding device and fixed above the stop beam 10 in the machine body 28, the stop beam 10 being fixed to the stop body 15 e.g. by a bolted joint. As mentioned above, the auxiliary body 41 is fixed to the machine body 28 to be movable in relation to the same. In FIGS. 4 and 5, the machine body 28 is shown by broken lines for better illustration.

To one vertical end of the auxiliary body 41 is fixed a horizontal transfer bar 19 of the linear guide arrangement, to which are fixed transfer carriages 16, 17 of the linear guide arrangement, which, in turn, are connected to a linear guide 18. Auxiliary body 41 accordingly is movable in a bidirectional translational fashion. The transfer body 27 mounted to the auxiliary body 41 is provided with a screw 21 with bearings 20 and 23 at the ends of the screw. A nut arrangement 22 is placed on the outer periphery of the screw, the nut being in turn fixed to the transfer bar 19 in a stationary manner. To the free end of the screw 21 (on the left in FIG. 4) is fixed via an overload switch 24 a servo motor or servo mechanism means 25, which is also fixed to the transfer body 27 mounted on the machine body 28. In connection with the servo motor 25, there is a pulse sensor or encoder 26, wherein both the pulse sensor 26 and the servo motor 25 are coupled to the control system or central numerical control (NC) 43 of the sheet machining center. With such configuration, roller 9 can be driven by servo motor 25 so as to effect bidirectional translational movements.

Figures 6A, 6B, 6C, 6D:
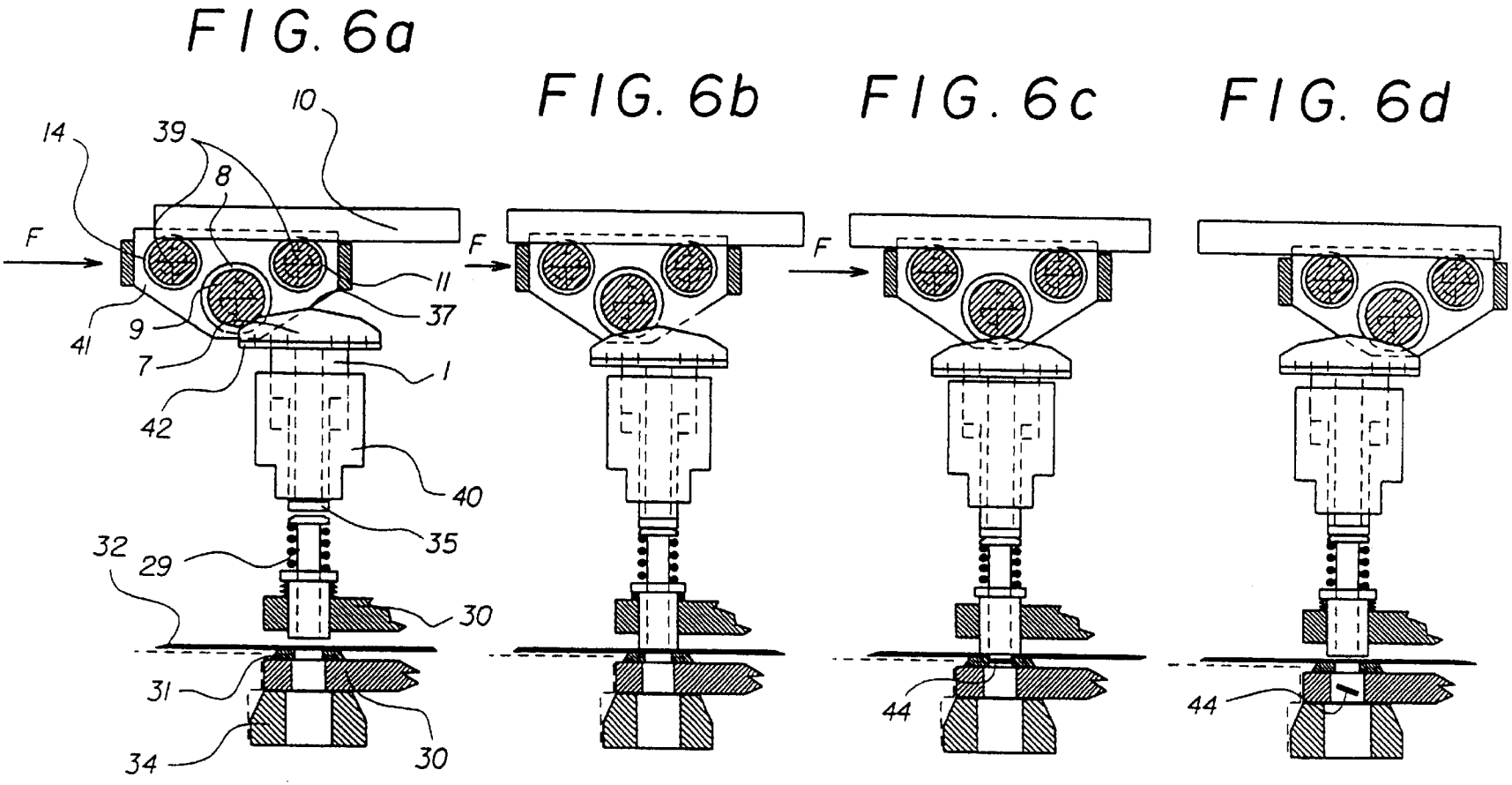

Further, FIG. 6*a–d* illustrates more closely details of the embodiment of FIGS. 1, 4 and 5 in the cutting machining application. FIG. 6*a* shows a tool exchange center where the second part 9 of the means 7, 9 is placed at the third portion 36*c* of the guide surface part 36, wherein the tool revolver 30 exchanges the tool 29, whereafter the buffer bar 1 is fixed by means 35 to the tool 29. In FIG. 6*b*, the linear movement of the second part 9 has advanced to a stage where the transfer or approaching movement of the tool 29 by the contact surface connection is completed in the area of the first portion 36*a* of the guide surface part. FIG. 6*c* shows a punching movement, wherein a waste piece 44 detached in the punching movement is pushed by the final stage of the punching movement inside the die 31. Thus, the second part 9 of the means 7, 9 has, at the final stage of the working movement, already passed the inversion point 37. FIG. 6*d*, in turn, shows the initial position of a new approaching and working movement, i.e. a so-called sheet transfer position, wherein after completion of the previous working stage, the sheet 32 is moved by an X,Y transfer device 33 to a new working position. The second part 9 is thus placed at the end of the first part 36*a* of the guide surface part 36, which is in connection with the third portion 36*c* of the guide surface part. The position of the second part 9 on the first portion 36*a* can naturally be selected according to the thickness of the sheet 32.

Figure 1B:
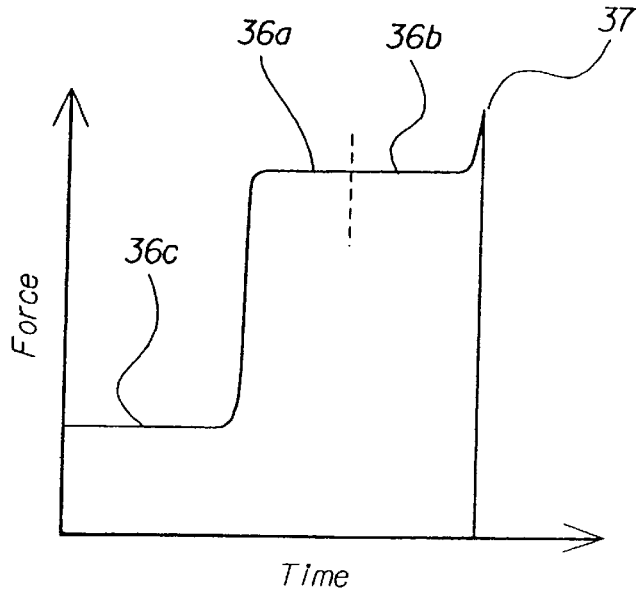
Figure 1C:
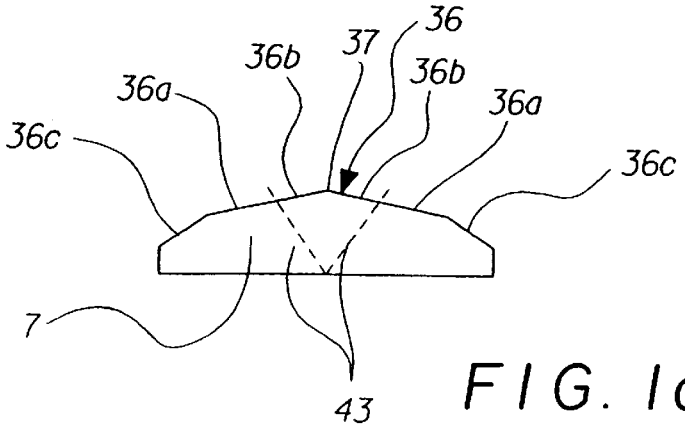
Figures 7A, 7B, 7C:
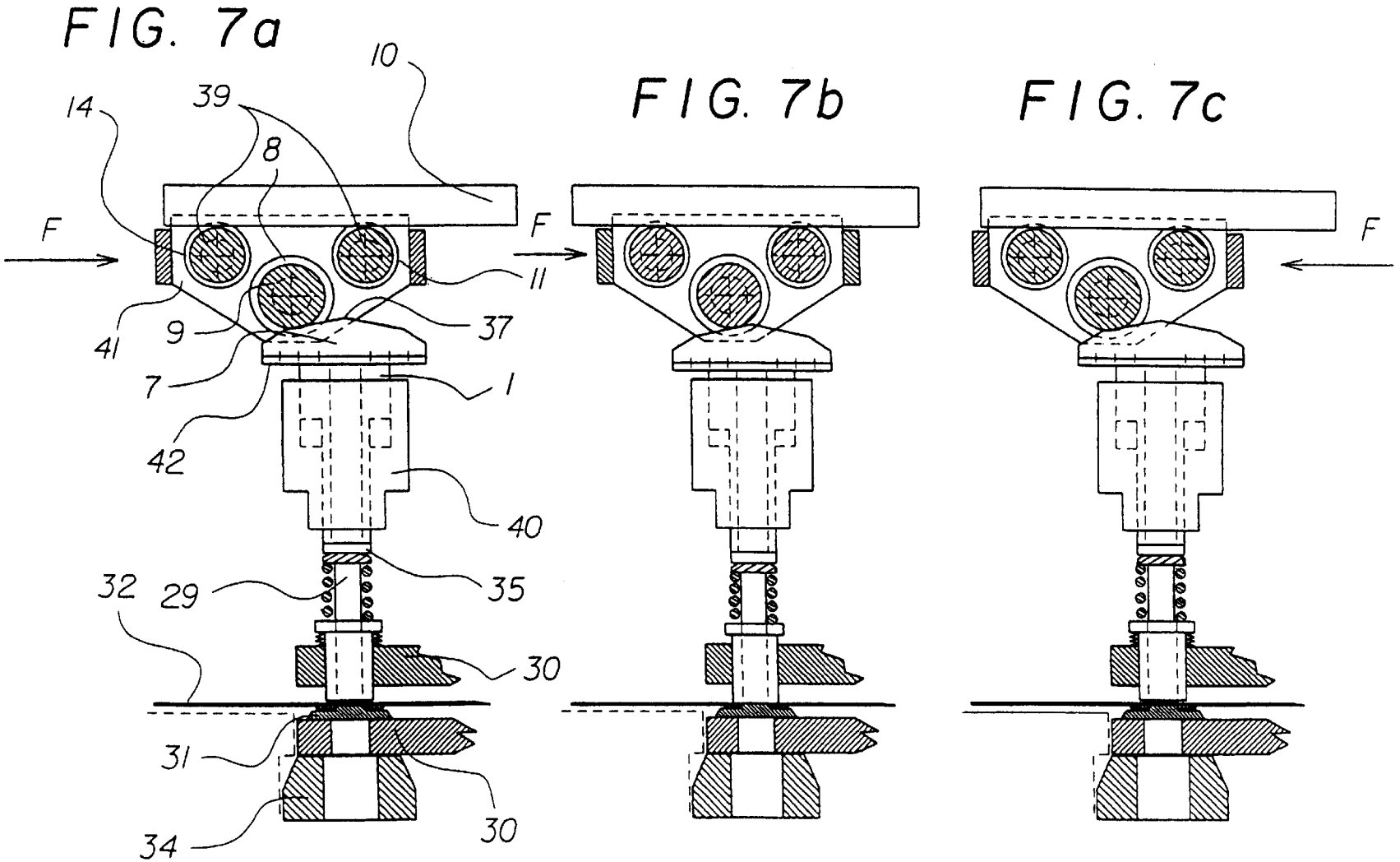

FIG. 7*a–c* shows a molding application with the apparatus of FIG. 6, wherein the second part 9 moves back and forth on the portions 36*a* and 36*b* of the guide surface part 36 and thus does not exceed the inversion (or apex) point 37 (cf. FIG. 1*b*). FIG. 7*a* shows the initial stage of molding machining, where the sheet 32 is molding against the die 31, and FIG. 7*c* shows a sheet transfer position corresponding substantially to the situation of FIG. 7*a*.

Consequently, the method of the invention can be applied in all methods intended for machining of a sheet, such as edging, bending, punching, and molding, where working is conducted by pressing. Thus, at the general level that is obvious to a man skilled in the art, it can be mentioned that a working machine comprises a first ET and a second TT (cf. FIG. 4), particularly upper and lower machining means in the machine body 28, at least the first one ET being arranged to move in relation to the machine body 28 towards the second one TT, to accomplish machining of a sheet material based on the utilization of a pressing force, wherein the sheet material to be worked is placed between the machining means ET and TT. Thus, at least one of the machining means ET and TT is provided with means 7, 9 for conducting the transfer and working movements of said tool ET, TT. The first part 7 of the means is fixed to the machining means ET and/or TT, and the second part 9 of the means is fixed to the machine body 28, to be movable in relation thereto by actuators 10, 11, 14–26, 39, 41 in the machine body (the reference numerals 11 and 14 refer to the rolling bearings of the rolls 39). The movement of the second part 9 of the means 7, 9 in relation to the machine body 28 during machining based on pressing of the sheet material is transmitted from the second part 9 to the first part 7 by a contact surface connection. The first part 7 and/or the second part 9 of the means 7, 9 is equipped with at least one guide surface part 36 which is formed as a bevelled surface in relation to the direction of movement of the machining means ET, TT. The position of the contact surface connection between the first part 7 and the second part 9 of the means in relation to the guide surface part 36 will define the position of the machining means ET and/or TT in relation to the machine body 28.

What is claimed is:

1. A sheet fabrication machine, comprising:

a one and an other machining means in a machine body, said one and other machining means being arranged in alignment to move relatively towards each other in relation to said machine body to machine a worksheet placed therebetween;

at least one of said machining means being provided with contact means for effecting its transfer and working movements, one part of said contact means being fixed to said one machining means and an other part of said contact means being movably coupled to said machine body and driven by at least one actuator, the movement of said one part relative to said machine body being effected via a contact surface connection by said other part;

wherein at least one of said one part and said other part includes at least one guide surface part formed as a beveled surface in relation to the direction of movement of said machining means;

wherein the position of said contact surface connection between said one part and said other part relative to said guide surface part defines the position of said one machining means, said guide surface part being provided with at least a first portion for effecting the transfer movements of said one machining means and a second portion for effecting the working movements of said one machining means on said worksheet; and wherein said one part and said other part are arranged in successive order in a manner that at least achieves one working cycle when said actuator drives said other part.

2. Machine of claim 1, wherein said actuator effects movement in one direction to drive said other part.

3. Machine according to claim 2, wherein said one guide surface part is arranged to be symmetrical and uniform in relation to an inversion point of said guide surface part, said inversion point being placed on a central line parallel to the longitudinal direction of said one of said one and other parts of said contact means of said machining means, said inversion point defining the final position of the machining movement of said tool.

4. Machine of claim 1, wherein said actuator effects a back and forth movement to drive said other part.

5. Machine of claim 1, wherein said actuator effects a continuous movement to drive said other part.

6. Machine according to claim 1, wherein said one guide surface part comprises a third portion for effecting said machining means to move to a position for exchanging said tool.

7. Machine according to claim 1, wherein said one part and said other part of said contact means are formed as at least one rolling means having a peripheral surface arranged to be in contact with said one guide surface part.

8. Machine according to claim 1, wherein the movement of said other part is arranged as a linear movement directed substantially perpendicularly to the longitudinal direction of said one and other machining means.

9. Machine according to claim 1, wherein said one guide surface part is arranged as a surface of said one part having at least one straight and/or curved portion beveled against the longitudinal direction of said one of said one and other machining means.

10. Machine according to claim 1, wherein said other part is placed in an auxiliary body equipped with a rolling means controlled by a guiding device in said machine body.

11. Machine according to claim 1, wherein the movement of said other part is arranged as a rotational movement.

12. Machine according to claim 11, wherein the central line of the rotational movement of said other part is in alignment with the central line of the longitudinal direction of said one of said one and other machining means.

13. Machine according to claim 1, wherein either said one part or said other part is defined by two or more consecutive zones in the longitudinal direction, each of said zones containing a guide surface part for effecting the same series of movements for said one of said one and other machining means during the rotational movement of said other part.

14. Machine according to claim 1, wherein the longitudinal direction of the central line of the rotational movement of said other part is placed in a beveled or perpendicular position in relation to a longitudinal direction of the central line of said one of said one and other machining means.

15. Machine according to claim 1, wherein said one part has a curved guide surface and said other part has a surface having two or more rolling means arranged in succession along its perimeter for making contact with said one part when said other part is rotated.

16. A sheet fabrication machine, comprising:

a one and an other machining means in a machine body, said one and other machining means being arranged to move relatively towards each other in relation to said machine body to machine a worksheet placed therebetween;

at least one of said machining means being provided with contact means for effecting its transfer and working movements, one part of said contact means being fixed to said one machining means and an other part of said contact means being movably coupled to said machine body and driven by at least one actuator, the movement of said one part relative to said machine body being effected via a contact surface connection by said other part;

wherein at least one of said one part and said other part includes at least one guide surface part formed as a beveled surface in relation to the direction of movement of said machining means;

wherein the position of said contact surface connection between said one part and said other part relative to said guide surface part defines the position of said one machining means, said guide surface part being provided with at least a first portion for effecting the transfer movements of said one machining means and a second portion for effecting the working movements of said one machining means on said worksheet;

wherein said one part and said other part are arranged in successive order in a manner that at least achieves one working cycle when said actuator drives said other part;

a work surface in said machine body on which said worksheet is placed, said worksheet being moved along said work surface by a holder movable in the X and Y directions;

wherein said other machining means is a die substantially positioned on the plane of said work, and said one machining means includes a punch positioned on the opposite side of said die in relation to said worksheet for transmitting a machining force to a tool;

wherein said contact means effects movements in a direction substantially perpendicular to the plane of said punch and said die, said one part of said contact means being fixed to said punch and said other part of said contact means being fixed to said machine body so as to be movable in relation thereto by said actuator;

wherein the machining force to said tool is transferred by said contact surface connection from said other part to said one part as said other part moves in relation to said machine body, said one part of said contact means including said one guide surface part formed as a beveled surface relative to the longitudinal direction of said punch;

wherein the location of said contact surface connection between said one part and said other part of said contact means in relation to said one guide surface part determines the position of said punch and thus said tool; and wherein said guide surface part includes at least a first portion for effecting the transfer movements of said punch and a second portion for effecting the working movements of said punch for machining said worksheet.

* * * * *